US009908656B2

(12) United States Patent
Dahlmann et al.

(10) Patent No.: US 9,908,656 B2
(45) Date of Patent: Mar. 6, 2018

(54) CAPPED WRAP DISPENSER

(71) Applicant: Pratt Industries, Inc., Conyers, GA (US)

(72) Inventors: Deborah A. Dahlmann, Marietta, GA (US); Christopher M. Stanton, Peachtree City, GA (US); John Richard Muse, Douglasville, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 0 days.

(21) Appl. No.: 14/609,567

(22) Filed: Jan. 30, 2015

(65) Prior Publication Data

US 2016/0221704 A1 Aug. 4, 2016

(51) Int. Cl.
*B65B 67/08* (2006.01)
*B65H 75/18* (2006.01)

(52) U.S. Cl.
CPC ..... *B65B 67/085* (2013.01); *B65H 75/185* (2013.01); *B65H 2402/41* (2013.01)

(58) Field of Classification Search
CPC ..... B65B 67/085; B65H 16/04; B65H 2402/412; B65H 75/185; B65H 75/406
USPC ..... 242/588, 588.2
See application file for complete search history.

(56) References Cited

U.S. PATENT DOCUMENTS 1,364,259 A * 1/1921 Eaton ..... B65H 59/04 242/129.8
1,451,914 A 4/1923 Kongsrud
1,935,392 A 11/1933 Coninck
2,331,743 A 10/1943 Sullivan
3,856,229 A 12/1974 Byram
4,102,513 A 7/1978 Guard
4,166,589 A 9/1979 Hooever et al.
4,179,081 A 12/1979 Parry
4,226,380 A 10/1980 Gay
4,248,392 A * 2/1981 Parry ..... B65B 67/085 242/422.1
4,339,022 A 7/1982 Hoover
(Continued)

FOREIGN PATENT DOCUMENTS

DE 1924348 11/1970
DE 202004011730 11/2004
(Continued)

OTHER PUBLICATIONS

Stanton, Christopher M.; Notice of Allowance for U.S. Appl. No. 14/108,881, filed Dec. 17, 2013, dated Nov. 24, 2015, 5 pgs.
(Continued)

*Primary Examiner* — Michael Gallion
(74) *Attorney, Agent, or Firm* — Taylor English Duma LLP

(57) ABSTRACT

A dispenser includes a rotating member including a first end and a second end, the rotating member having an inner surface and defining an axis of rotation that extends from the first end to the second end; a holding member having an inner surface and an outer holding surface, the inner surface enclosing an engaging portion of the rotating member; and a cap attached to the first end of the rotating member and holding the holding member, the cap including an outer circumferential wall and an inner circumferential wall, the cap enclosing a portion of the holding member between the outer circumferential wall and the inner circumferential wall.

24 Claims, 8 Drawing Sheets

(56) References Cited

U.S. PATENT DOCUMENTS 4,372,500 A 2/1983 Saraisky
D268,514 S 4/1983 Thompson
4,477,037 A 10/1984 Goldstein
4,484,717 A 11/1984 Goldstein
4,530,473 A 7/1985 Parry
4,575,020 A 3/1986 Strout et al.
4,600,163 A 7/1986 Hummel et al.
4,659,031 A 4/1987 Saraisky
4,706,442 A * 11/1987 Riemenschneider . B65B 67/085 242/423.1
4,722,493 A 2/1988 Parry et al.
4,752,045 A 6/1988 Goldstein
4,784,348 A 11/1988 McDonald
4,817,762 A 4/1989 Powell
4,834,312 A 5/1989 Riemenschneider, III
4,872,623 A 10/1989 Parry et al.
4,874,139 A 10/1989 Kewin
4,971,265 A 11/1990 Koch
5,094,395 A 3/1992 Lambert
5,135,179 A 8/1992 Morano
5,150,852 A 9/1992 Hunt et al.
5,186,376 A 2/1993 Scharf et al.
5,190,237 A * 3/1993 Fagan ..... A63H 27/002 192/69.2
5,203,517 A * 4/1993 Parry ..... B65B 67/085 242/422.4
5,351,905 A * 10/1994 Ferber ..... B65B 67/085 242/588.2
5,398,884 A 3/1995 Stanford
5,409,177 A 4/1995 Parry et al.
5,490,642 A 2/1996 Schwartz et al.
D371,298 S 7/1996 Reddy et al.
5,573,630 A 11/1996 Edney et al.
5,664,739 A * 9/1997 Black ..... B65H 75/406 242/588.2
5,868,334 A * 2/1999 Cedillo ..... B65H 75/406 206/420
5,915,642 A 6/1999 Davis
5,927,635 A * 7/1999 Black ..... B65H 75/406 242/395
5,938,142 A 8/1999 Halperin
5,961,063 A 10/1999 Parry
6,015,111 A * 1/2000 Berke ..... A01K 89/003 242/250
6,019,308 A 2/2000 Huang
6,027,069 A * 2/2000 Huang ..... B65B 67/085 242/588.2
D424,341 S 5/2000 Anderberg
D425,347 S 5/2000 Anderberg
6,102,323 A 8/2000 Riemenschneider
6,227,479 B1 5/2001 Dean et al.
6,227,480 B1 5/2001 Huang
6,398,150 B1 6/2002 Munter et al.
6,491,252 B2 12/2002 Komatsu et al.
6,508,430 B1 1/2003 Rodriguez
6,517,023 B2 2/2003 Rodriguez
6,651,918 B2 11/2003 Huang
6,676,069 B1 * 1/2004 Davis ..... B65H 75/146 242/405.2
6,739,542 B1 5/2004 Prina et al.
6,883,298 B2 4/2005 Gooding et al.
6,892,975 B2 5/2005 Chen
6,905,045 B2 6/2005 Chen
6,926,225 B1 8/2005 Powers
6,997,411 B2 2/2006 Kewin
7,017,743 B1 * 3/2006 Patterson ..... B65D 11/02 206/408
7,210,649 B2 5/2007 Yu Chen
7,380,744 B1 * 6/2008 Yu Chen ..... B65H 16/005 242/422.4
7,401,449 B2 * 7/2008 Watson ..... B65B 67/085 242/423
7,438,254 B2 10/2008 Oettershagen
D593,464 S 6/2009 Mentis
7,543,426 B1 6/2009 Phero
7,552,891 B2 6/2009 Huang
7,665,686 B2 2/2010 Becker et al.
D612,179 S 3/2010 Huang
7,726,600 B2 * 6/2010 Huang ..... B65B 67/085 242/588.2
7,762,490 B1 7/2010 Yu Chen
7,866,596 B2 1/2011 Yamada
7,900,421 B2 3/2011 Smith
7,937,915 B2 5/2011 Kohn et al.
8,104,705 B2 1/2012 Yu Chen
8,308,102 B2 11/2012 Lin
8,317,124 B2 11/2012 Yu Chen
8,468,778 B2 6/2013 Windheuser
8,578,683 B2 11/2013 Smith
8,616,490 B2 12/2013 Blok
8,622,332 B2 1/2014 Bologna
8,708,267 B2 4/2014 Morgan
8,783,428 B2 7/2014 Beri
9,010,675 B2 * 4/2015 Harrison ..... B65B 67/085 242/578.2
9,272,870 B2 3/2016 Stanton
9,284,085 B2 * 3/2016 Pace ..... B65B 67/085
9,688,507 B2 6/2017 Stanton
2003/0132336 A1 7/2003 Huang
2004/0065577 A1 * 4/2004 Yu Chen ..... B65B 67/08 206/497
2004/0084559 A1 5/2004 Fraser
2004/0245282 A1 * 12/2004 Yu Chen ..... B65B 67/085 222/33
2006/0032965 A1 * 2/2006 Yu Chen ..... B65H 16/02 242/422.4
2006/0071118 A1 * 4/2006 Offerhaus ..... B65H 75/185 242/573.9
2006/0175460 A1 8/2006 Hua
2006/0237577 A1 * 10/2006 Chen ..... B65D 85/02 242/588
2006/0278751 A1 12/2006 Chen
2007/0063092 A1 * 3/2007 Zevin ..... B65H 16/06 242/571.5
2007/0151208 A1 * 7/2007 Huang ..... B65B 67/085 53/390
2008/0072538 A1 3/2008 Kohn et al.
2008/0258002 A1 10/2008 Migliaccio
2009/0044494 A1 2/2009 Northrup
2009/0127372 A1 5/2009 Saraisky
2009/0308968 A1 12/2009 Piotrowski et al.
2010/0044491 A1 2/2010 Ritchey et al.
2011/0095122 A1 4/2011 Yu Chen
2011/0233321 A1 9/2011 Yu Chen
2011/0284680 A1 11/2011 Lin
2012/0153063 A1 6/2012 Furuichi
2012/0181369 A1 7/2012 Blok
2013/0152384 A1 6/2013 Yu Chen
2014/0116004 A1 5/2014 Pace
2015/0166285 A1 6/2015 Stanton
2016/0137454 A1 5/2016 Stanton

FOREIGN PATENT DOCUMENTS

EP 0030572 6/1981
EP 0227564 7/1987
EP 0310291 4/1989
EP 0499761 8/1992
FR 2588841 5/1988
FR 2910887 12/2009
GB 2055345 3/1981
GB 2289039 11/1995
GB 2299321 10/1996
GB 2456801 7/2009
GB 2478933 9/2011
JP H0769349 3/1995
TW 201026567 7/2010
WO 9310006 5/1993

(56) References Cited

FOREIGN PATENT DOCUMENTS

| | | |
|---|---|---|
| WO | 9500395 | 1/1995 |
| WO | 2007066194 | 6/2007 |

OTHER PUBLICATIONS

Stanton, Christopher M.; U.S. Patent Application entitled: Braking Wrap Dispenser having U.S. Appl. No. 15/001,281, filed Jan. 20, 2016, 30 pgs.
Stanton, Christopher M.; Issue Notification for U.S. Appl. No. 14/108,881, filed Dec. 17, 2013, dated Feb. 10, 2016, 1 pg.
Stanton, Christopher M.; U.S. Patent Application entitled: Braking Wrap Dispenser having U.S. Appl. No. 14/108,881, filed Dec. 17, 2013, 29 pgs.
Goodwrappers; "Unitization products by Goodwrappers, include hand wrappers, replacement rolls, core handwrap, generic and disposable hand wrap", Apr. 7, 2010, located at <https://web.archive.org/web/20100407080537/http:/www.goodwrappers.com/prod_unit.asp>, 4 pgs.
Images of Braking Wrap Film Dispenser, the Dispenser publicly available prior to Dec. 17, 2012, 12 pgs.
Vestil Manufacturing; "Stretch Wrap Dispensers", located at <http://www.vestilmfg.com/products/mhequip/stretch_wrap_dispensers.htm>, Copyright 2014, accessed on Aug. 11, 2014, 2 pgs.
Stanton, Christopher M.; Non-Final Office Action for U.S. Appl. No. 14/108,881, filed Dec. 17, 2013, dated Sep. 23, 2015, 29 pgs.
Dahlmann, Deborah H.; U.S. Patent Application entitled: Collared Wrap Dispenser having U.S. Appl. No. 14/642,940, filed Mar. 10, 2015, 31 pgs.
Stanton, Christopher M..; Non-Final Office Action for U.S. Appl. No. 15/001,281, filed Jan. 20, 2016, dated Jan. 11, 2017, 44 pgs.
"Hand Savers Stretch Wrap Film Hand Dispenser" www.ebay.com; http://www.ebay.com/itm/Hand-Savers-Stretch-Wrap-Film-Hand-Dispenser-1-set-/251286375179 (Accessed Jun. 10, 2013), 3 pgs.
"Stretch film—BK Holder" www.benkaico.com; http://www.benkaico.com/product-area/stretch-film—bk-holder (Accessed Jun. 10, 2013), 2 pgs.
"Stretch Film Dispenser—Hand Core Insert 3" www.aaabalingandstrapping.com http://www.aaabalingandstrapping.com/index.php?main_page=product_info&cPath=8&products_id=183&zenid=3tkfdrfajbi8ha9ducbdvfclv4 (Accessed Jun. 10, 2013), 2 pgs.
Stanton, Christopher M.; Notice of Allowability for U.S. Appl. No. 15/001,281, filed Jan. 20, 2016, dated Apr. 26, 2017, 6 pgs.
Stanton, Christopher M.; Notice of Allowance for U.S. Appl. No. 15/001,281, filed Jan. 20, 2016, dated Mar. 8, 2017, 5 pgs.
Stanton, Christopher M.; Issue Notification for U.S. Appl. No. 15/001,281, filed Jan. 20, 2016, dated Jun. 7, 2017, 1 page.

* cited by examiner

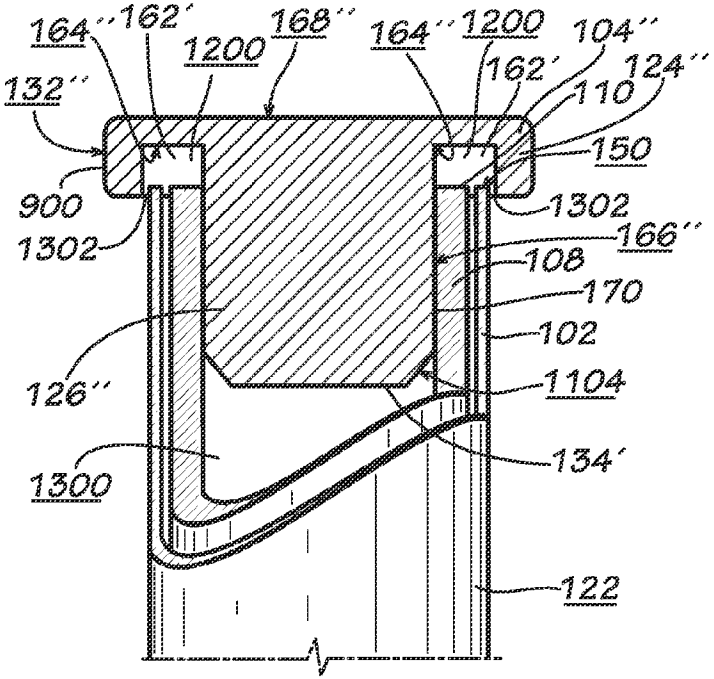
FIG. 11
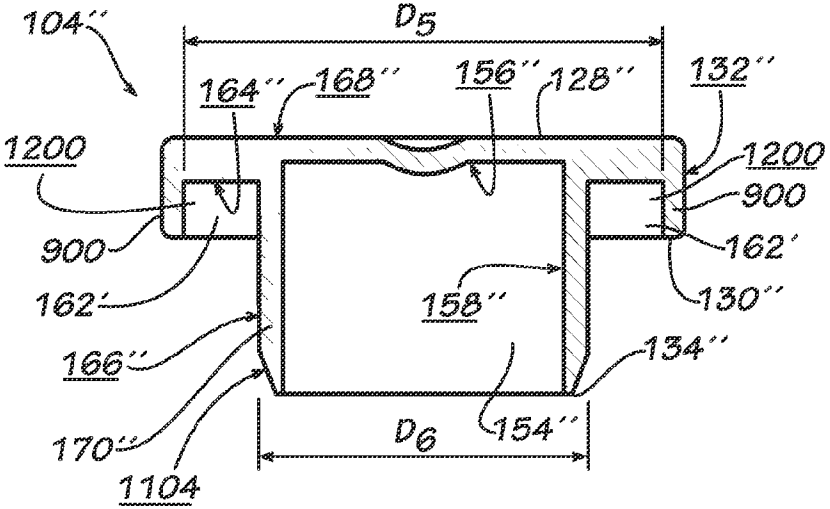
FIG. 12
FIG. 13

CAPPED WRAP DISPENSER

TECHNICAL FIELD

This disclosure relates to wrap dispensers. More specifically, this disclosure relates to wrap dispensers that allow an operator to dispense rolls of film or other wrap while holding onto the wrap dispenser.

BACKGROUND

Plastic or other sheets of material are sometimes used to wrap items for transport, storage, or other various reasons. For one example among others, wraps include thin plastic films, membranes, or sheets of any suitable material and are often rolled around a cylindrical paperboard core or other similar devices such as a spool made of another material that allows the wrap to be dispensed to facilitate the wrapping of items. This can protect the items from dust, water, and other contaminants found in the environment and can hold the items together. Types of plastic wraps may include plastic stretch wrap, which is commonly rolled around a paperboard core and used to secure and protect items during a move, such as wrapping furniture or bundling objects together. In many situations, this dispensing is done manually. Accordingly, it is desirable that the method of dispensing wrap is done in a safe but efficient manner.

SUMMARY

Disclosed is a dispenser including a rotating member including a first end and a second end, the rotating member having an inner surface and defining an axis of rotation that extends from the first end to the second end; a holding member having an inner surface and an outer holding surface, the inner surface enclosing an engaging portion of the rotating member; and a cap attached to the first end of the rotating member and holding the holding member, the cap including an outer circumferential wall and an inner circumferential wall, the cap enclosing a portion of the holding member between the outer circumferential wall and the inner circumferential wall.

Also disclosed is a method of assembling a wrap dispenser including enclosing an engaging portion of a rotating member with a holding member; and attaching a cap proximate to a first end of the rotating member by contacting an insertion portion of the cap to an inner surface of the rotating member and enclosing a portion of the holding member between an outer circumferential wall and an inner circumferential wall, the cap preventing removal of the holding member from the rotating member over the first end of the rotating member Also disclosed is a method of dispensing wrap from a roll using a dispenser, the method comprising: gripping onto an outer holding surface of a holding member of the dispenser, the holding member enclosing an engaging portion of a rotating member of the dispenser, the dispenser further including: wrap wrapped around a roll-holding portion of the rotating member, and a cap attached to the first end of the rotating member and holding the holding member, the cap including an outer circumferential wall and an inner circumferential wall, the cap enclosing a portion of the holding member between the outer circumferential wall and the inner circumferential wall; and dispensing the wrap by rotating the rotating member relative to the holding member.

Also disclosed is a dispenser comprising: a rotating member having a first end defining a continuous unbroken circle and a second end defining a continuous unbroken circle, the rotating member defining an axis of rotation that extends from the first end to the second end; a holding member having a first end defining a continuous unbroken circle and a second end defining a continuous unbroken circle, the holding member having an inner surface and an outer holding surface, the inner surface enclosing an engaging portion of the rotating member; and a cap attached to the first end of the rotating member and holding the holding member.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

FIG. 11 is a side view of the cap of FIG. 9.

FIG. 12 is a cross-sectional view of the cap of FIG. 11 taken along line 12-12.

FIG. 13 is a partial cross-sectional view of the cap, holding member, and rotating member of FIG. 9.

DETAILED DESCRIPTION

Disclosed is a wrap dispenser and associated methods, systems, devices, and various apparatus. In various embodiments, the dispenser includes at least one holding member and one rotating member that are joined in a rotatable fashion so that the rotating member may rotate while wrapped with wrap while the user holds the holding member. The terms "holding member" and "rotating member" may include any member that allows a user to, respectively, hold the holding member in the user's hand and allow the rotating member to freely rotate relative to the holding member. Furthermore, the term "wrap" should be interpreted broadly and should be applied to any material that is used to cover or protect objects, including but not limited to stretch wrap, film, bubble wrap, tape, foil, tissue paper, or wrapping paper. While it is particularly useful in applications for dispensing plastic film, sheets, or other wraps, it should not be so limited as it could be used with other dispensing operations or with other materials of any desired thickness that is used to cover, enclose, enwrap, or otherwise protect articles. It would be understood by one of skill in the art that the disclosed dispenser is described in but a few exemplary embodiments among many. No particular terminology or description should be considered on the disclosure or the scope of any claims issuing therefrom.

Figure 1:
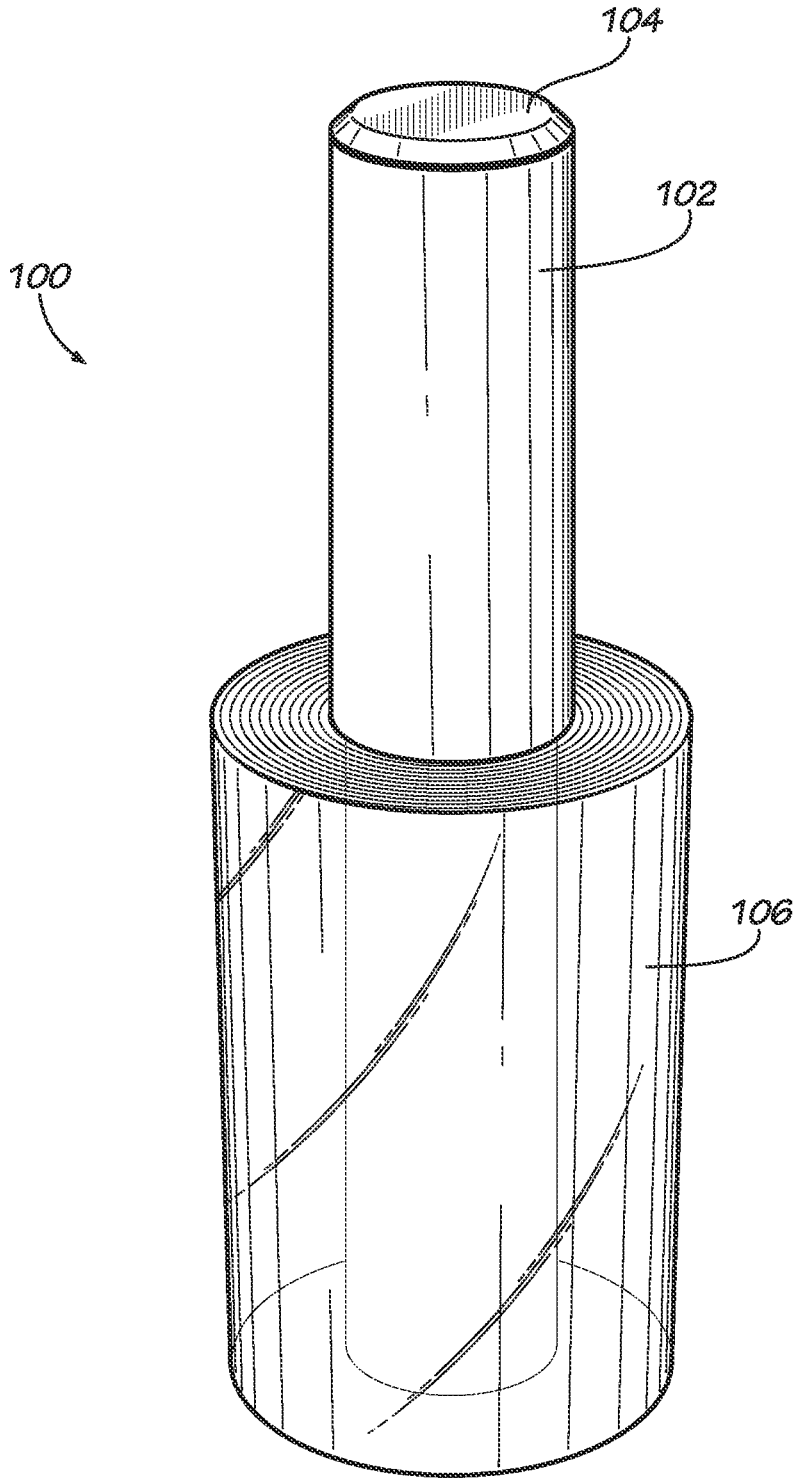
FIG. 1 is a perspective view of a wrap dispenser according to a first embodiment of the present disclosure including a holding member, a rotating member, and a cap.
Figure 2:
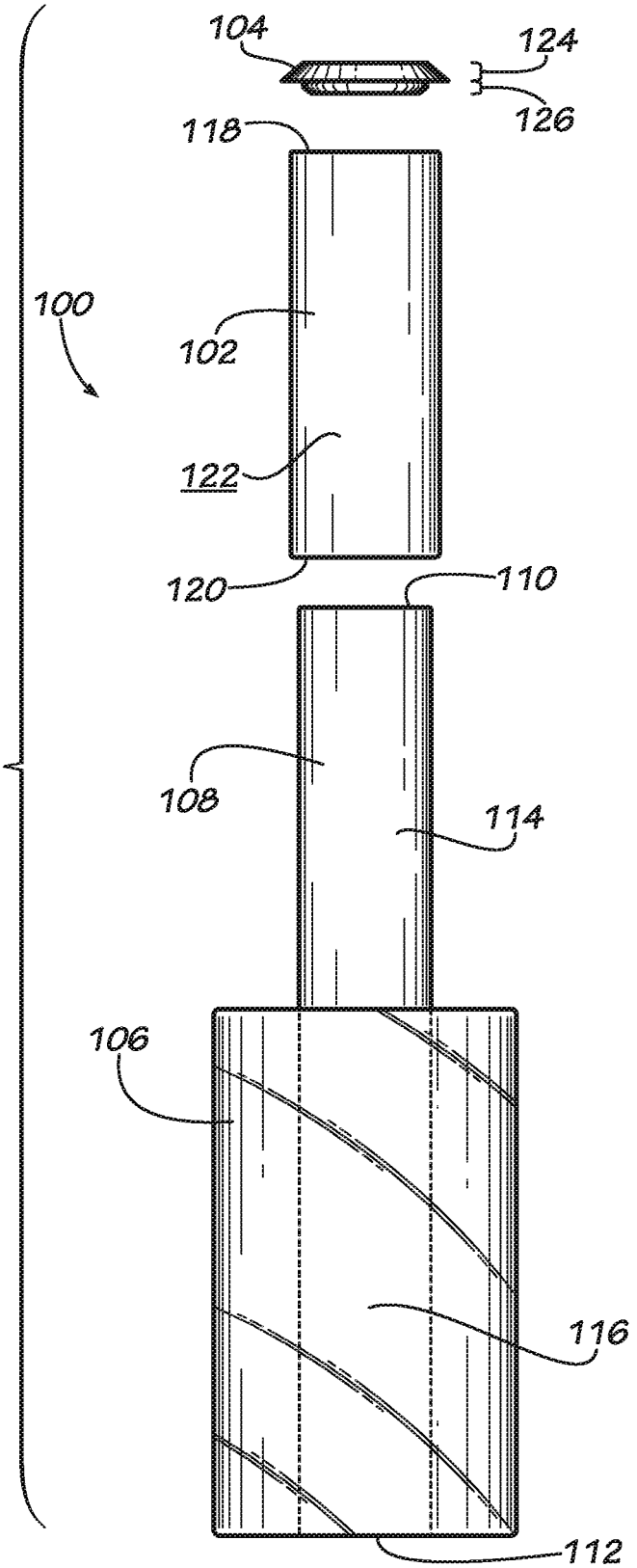
FIG. 2 is an exploded assembly view of the wrap dispenser of FIG. 1 showing how the rotating member, holding member, and a cap of the wrap dispenser are assembled.

One embodiment of a wrap dispenser 100 is shown and described in FIGS. 1 and 2. The wrap dispenser 100 comprises a holding member 102, a cap 104, and a rotating member 108 (shown in FIG. 2) having a roll of wrap 106 positioned over at least a part of the rotating member 108. In various embodiments, the wrap 106 is typically rolled around the rotating member 108 to create the roll of wrap 106 shown in FIG. 2. The rotating member 108 is thereby a spool around which the wrap 106 is rolled. In various embodiments, the rotating member 108 and holding member 102 are of substantially annular or tubular and are separate components, though other shapes may be present in various embodiments. In the current embodiment, the rotating member 108 and holding member 102 are both right cylinders having circular ends.

As shown in FIG. 2, in the current embodiment, the wrap dispenser 100 includes the holding member 102, the cap 104, and the rotating member 108 having a roll of wrap 106. In particular, the rotating member 108 has a first end 110 and a second end 112 and includes an engaging portion 114 and a roll-holding portion 116. In various embodiments, the first end 110 defines a continuous unbroken circle and the second end 112 defines a continuous unbroken circle. In various embodiments, the rotating member 108 is a continuous cylinder such that the cross-section of the rotating member 108 is consistently circular and unbroken from end-to-end with no cuts, slots, or holes therethrough. As shown in FIG. 2, the roll of wrap 106 is positioned on the roll-holding portion 116 of the rotating member 108. In various other embodiments, the rotating member 108 may further include a flange positioned on the rotating member 108 to separate the engaging portion 114 from the roll-holding portion 116.

In addition, the dispenser 100 includes the holding member 102, which is positioned on the engaging portion 114 of the rotating member 108 in the assembled dispenser 100. In various embodiments, the holding member 100 may be formed from spiral wrapping of a flat sheet including multiple layers of paper into a longer tubular shape. After the tubular shape is formed, the tubular shape may be cut to a desired length to form the holding member 102. However, the disclosure of spiral wrapping should not be considered limiting as in various other embodiments, the holding member 100 may be formed through other mechanisms such as wrapping a flat sheet into a tubular shape without spiraling. The holding member 102 has a first end 118 and a second end 120 and defines an outer holding surface 122 that a user may hold, grab, or clench when using the wrap dispenser 100 to dispense wrap such as film. In various embodiments, the first end 118 defines a continuous unbroken circle and the second end 120 defines a continuous unbroken circle. In various embodiments, the holding member 102 defines a continuous cylinder such that the cross-section of the holding member 102 is consistently circular and unbroken from end-to-end with no cuts, slots, or holes therethrough. In various embodiments, the holding member 102 may further include a flange positioned on the holding member 102 to protect the user's hand. In these embodiments, the flange may be positioned at the second end 120 of the holding member 102, at the first end 118 of the holding member 102, or at some intermediary position on the holding member 102 between the first end 118 and the second end 120, or in any combination of these positions. The dispenser 100 further includes the cap 104. In the current embodiment of the cap 104 shown in FIG. 2, the cap 104 has a flange portion 124 and an insertion portion 126. The cap 104 will be described below in greater detail with reference to FIGS. 5 and 6.

Figure 3:
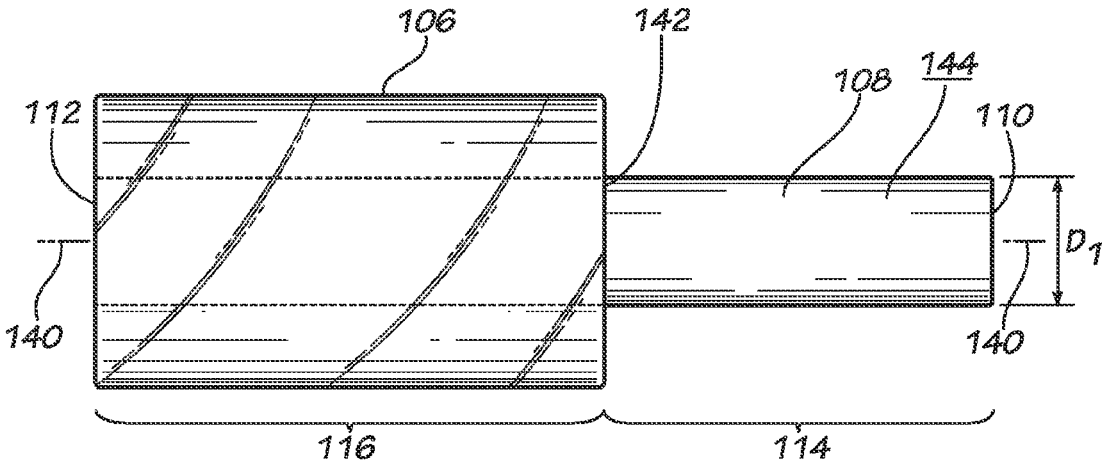
FIG. 3 is a side view of the rotating member of the wrap dispenser of FIG. 1.

As shown in FIG. 3, the rotating member 108 has a substantially annular or tubular configuration in the current embodiment. Consequently, in the current embodiment, the rotating member 108 has a diameter $D_1$ and a longitudinal axis which is the axis of rotation 140 that extends from its first end 110 to its second end 112. The rotating member 108 also includes an outer surface 144 and an inner surface 1300 (shown in FIG. 13). As shown FIG. 3, the rotating member 108 includes the engaging portion 114 and a roll-holding portion 116. The engaging portion 114 is generally the area of the outer surface 144 from the first end 110 to some intermediary position 142 on the outer surface 144 of the rotating member 108 where the holding member 102 will be positioned and a user can grasp the dispenser 100. The roll-holding portion 116 is generally the area of the outer surface 144 from the second end 112 to the intermediary position 142 on the outer surface 144 of the rotating member 108 where the roll of wrap 106 will be positioned on the rotating member 108. In the present embodiment, the length of the roll-holding portion 116 is greater than the length of the engaging portion 114. However, in various other embodiments, the length of the engaging portion 114 may be equal to or less than the length of the roll-holding portion 116.

In various embodiments, the outer surface 144 of the rotating member 108 in the engaging portion 114 interacts with an inner surface 146 (shown in FIG. 4) of the holding member 102, which will be described in further detail below. In the current embodiment, the roll-holding portion 116 of the rotating member 108 is substantially cylindrical and the outer surface 144 in the roll-holding portion 116 is a smooth surface. In various other embodiments, the roll-holding portion 116 of the rotating member 108 includes at least one roll grip on the outer surface 144. In these embodiments, the at least one roll grip is a rib or a raised surface protruding radially outward from the outer surface 144 on the roll-holding portion 116 of the rotating member 108. In these embodiments, the at least one roll grip engages the inside of the roll of wrap 106 in a frictionally desirable manner to help keep the roll of wrap 106 from falling off the dispenser 100.

In the current embodiment, rotating member 108 is constructed from paperboard and the inner surface is a smooth cylindrical surface. In various embodiments where the dispenser 100 includes the cap 104, the cap 104 biases the attachment mechanism of the cap 104 against the inner surface of the rotating member 108 such that the attachment mechanism digs into the inner surface of the rotating member 108. In various other embodiments, includes connecting mechanisms such as threading, grooves, fasteners, adhesives, or various other connecting mechanisms to engage the attachment mechanism of the cap 104. In various embodiments, the connecting mechanisms of the rotating member 108 are defined or positioned on the inner surface proximate to the first end 110, on the outer surface 144 proximate to the first end 110, or on both the inner surface and outer surface 144 proximate to the first end 110.

Figure 4:
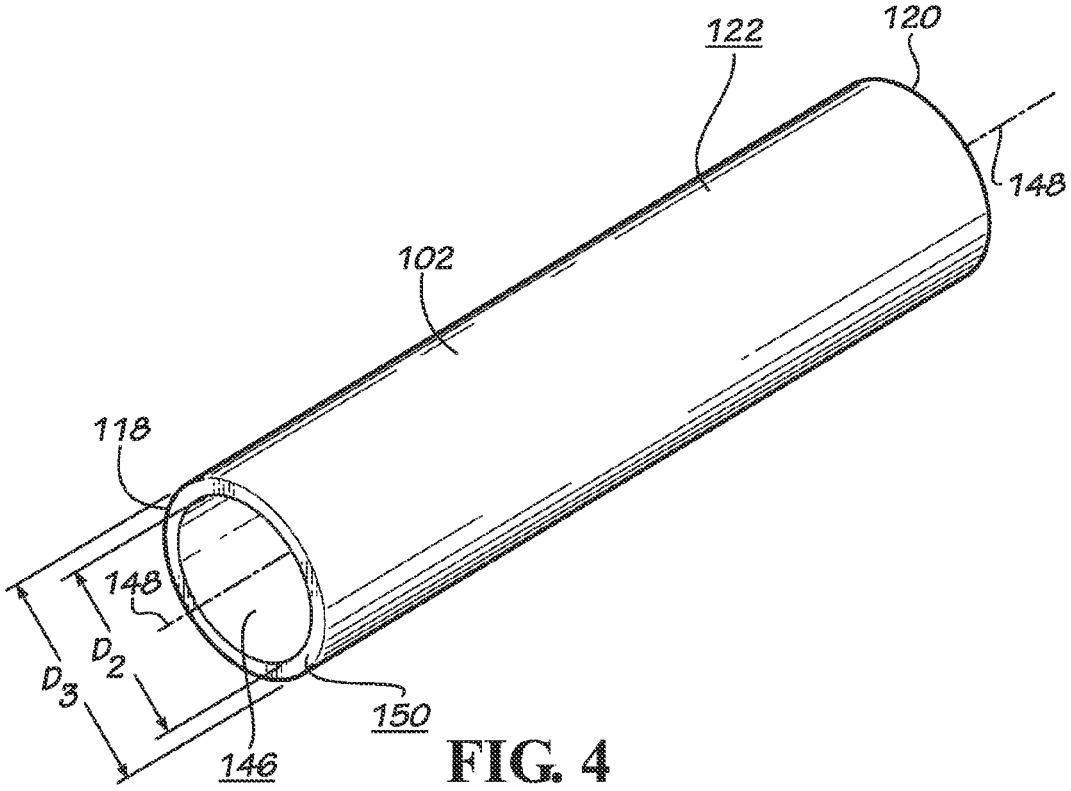
FIG. 4 is a perspective view of the holding member of the wrap dispenser of FIG. 1.

As shown in FIG. 4, the holding member 102 has a substantially annular or tubular configuration with a longitudinal axis 148 that extends from its first end 118 to its second end 120. The holding member 102 includes the outer holding surface 122 and an inner surface 146. As previously described, the user may hold, grab, or clench the outer holding surface 122 when using the wrap dispenser 100 to dispense wrap such as film. In various embodiments, the holding member 102 can include images, words, and other designs printed or imprinted on the outer holding surface 122. As described below with reference to FIG. 10, in various embodiments, the outer holding surface 122 with printed or imprinted designs may serve aesthetic purposes such as creative designs to ornament the holding member 102. In various other embodiments, the outer holding surface 122 with printed or imprinted designs may serve utilitarian purposes such as to provide instructions for use of the wrap dispenser 100 or advertising space for companies or other entities to print or imprint their images, logos, slogans, or any other design associated with that entity. In various embodiments, the outer holding surface 122 may include a single image, word, or design or a plurality of images, words, or designs.

As shown in FIG. 4, the inner surface 146 defines a first diameter $D_2$, which is greater than rotating member diameter $D_1$, and the outer holding surface 122 defines a second diameter $D_3$, which is greater than $D_2$. The holding member 102 also has a length which is defined as the distance from the first end 118 to the second end 120. In the present embodiment, this holding member 102 length is less than the length of the engaging portion 114 of the rotating member 108. However, in other embodiments, the length of the engaging portion 114 may be equal to or less than the length of the holding member 102. The holding member 102 further includes a cap side surface 150 at the first end 118 and a roll side surface (not shown) at the second end 120.

In the current embodiment, the inner surface 146 is a smooth surface that is substantially cylindrical. As described below, in various embodiments, the inner surface 146 can frictionally engage the engaging portion 114 of the rotating member 108 upon compression of the holding member 102. In various other embodiments, the inner surface 146 includes at least one roll grip on the inner surface 146. In these embodiments, the at least one roll grip is a rib or a raised surface protruding radially inward from the inner surface 146 of the holding member 102. In these embodiments, the at least one roll grip can engage the engaging portion 114 of the rotating member 108 to frictionally engage the rotating member 108.

Figure 5:
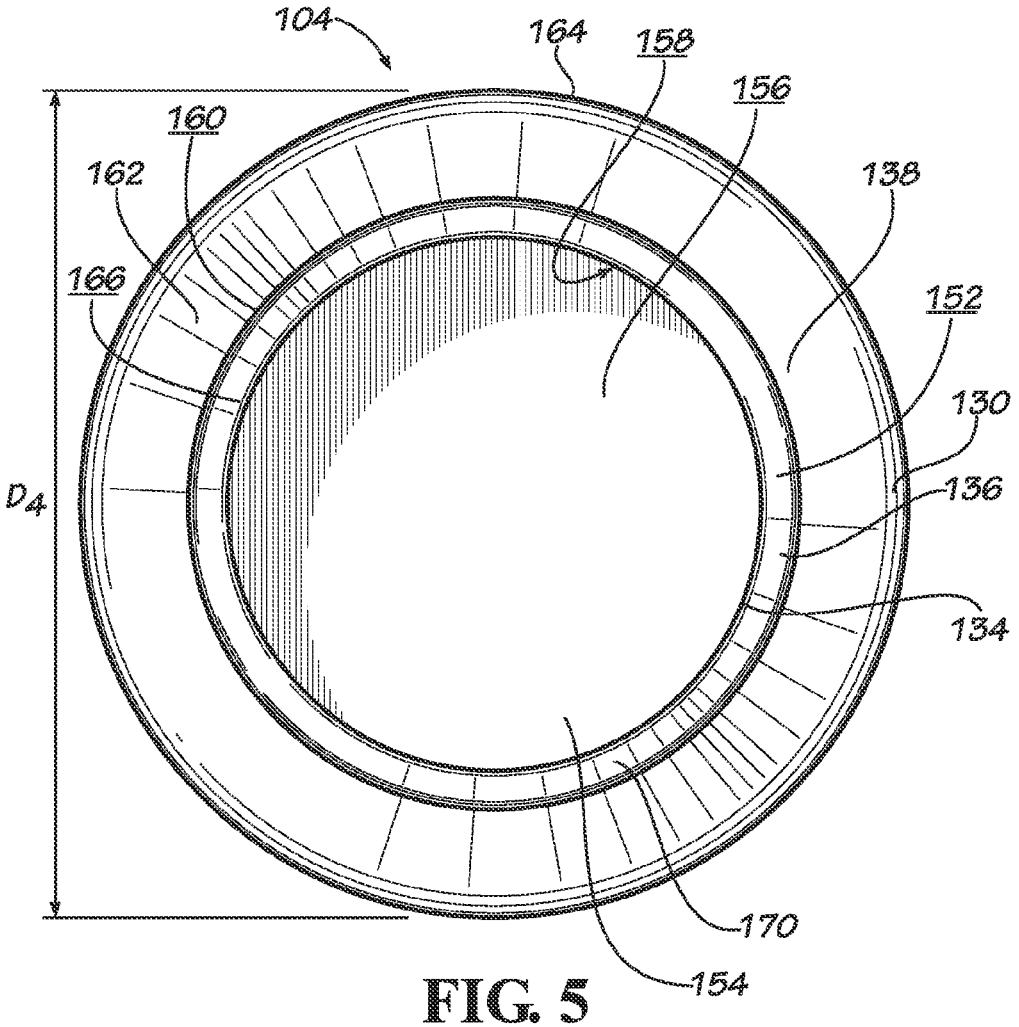
FIG. 5 is a bottom view of the cap of FIG. 1.
Figure 6:
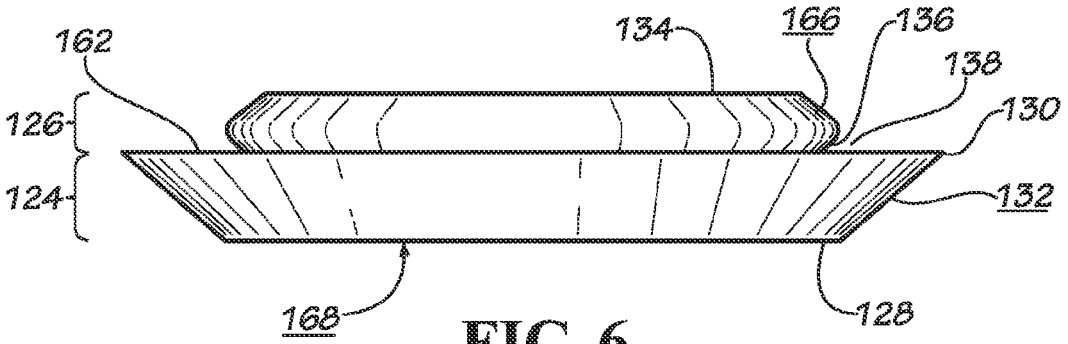
FIG. 6 is a side view of the cap of FIG. 1.

FIGS. 5 and 6 show a bottom view and side view, respectively, of the cap 104. As previously described, the cap 104 includes the flange portion 124 and the insertion portion 126. The flange portion 124 includes a side surface 132 having a first end 128 and a second end 130. As shown in FIG. 6, in various embodiments, the side surface 132 is angled or tapered between the first end 128 and the second end 130; however, in various other embodiments, the side surface 132 is rounded, tapered, or is any other desired shape between the first end 128 and the second end 130.

In the current embodiment, the insertion portion 126 has a circumferential wall 170 having an outer surface 166 and defining a cavity 154 extending inward from the second end 134 into the insertion portion 126 (shown in FIG. 5). As shown in FIGS. 5 and 6, in various embodiments, the outer surface 166 defines a rib 136 and a groove 138 as an attachment mechanism to attach the cap 104 to the dispenser 100. The disclosure of the rib 136 and groove 138 should not be considered limiting on the current disclosure. In various other embodiments, the attachment mechanism may be threading, adhesives, fasteners, or various other attachment mechanisms.

As shown in FIG. 6, the cap 104 defines an outer surface 168. As shown in FIG. 5, in various embodiments, the cap 104 defines the cavity 154 at the second end 134 extending into the insertion portion 126. In various embodiments, the cavity 154 includes a bottom surface 156 and an annular or ring-shaped side surface 158 extending from the bottom surface 156 to the second end 134. As will be described below, in various embodiments, the outer surface 166 of the cavity 154 defines the rib 136 and groove 138 as an attachment mechanism. In various other embodiments, the outer surface 166 may define or be connected to various other attachment mechanisms. In various other embodiments, the cap 104 includes tabs or other structures for enabling the cap 104 to have an attachment mechanism.

As shown in FIG. 5, the cap 104 has a generally circular shape with an outermost diameter $D_4$ defined by end 130. In various embodiments, $D_4$ is equal to $D_3$; however, in various other embodiments, $D_4$ may be greater than $D_3$ or less than $D_3$ but at least equal to $D_2$. The shape of the cap 104 should not be considered limiting on the current disclosure as in various other embodiments, the cap 104 may be square, oval, angled, or have any other desired shape. As shown in FIG. 5, in various embodiments, the cap 104 includes an inner surface 160. In various embodiments, the inner surface 160 defines an annular pocket 162 into which the rotating member 108 is inserted when the cap 104 is attached to the rotating member 108. As shown in FIG. 5, the cap 104 can also define an annular end surface 164 in various embodiments. When the cap 104 is attached to the dispenser 100, the annular end surface 164 is positioned adjacent to the cap side surface 150 of the holding member 102 such that the cap side surface 150 can abut the annular end surface 164 even though the holding member 102 is not attached to the cap 104. In various embodiments, the annular end surface 164 can contact the cap side surface 150 of the holding member 102 such that the holding member 102 is slidable against the cap 104.

In various embodiments, the attachment mechanism includes the rib 136 and groove 138, although in various other embodiments, various other attachment mechanisms may be utilized. In various embodiments, the rib 136 (or other attachment mechanisms) is configured to engage the inner surface of the rotating member 108 upon insertion of the insertion portion 126 of the cap 104 into the rotating member 108. In these embodiments, the rib 136 is configured to be biased against and dig into the inner surface of the rotating member 108. The rib 136 has an outer diameter slightly larger than the inner surface of the rotating member 108 in the current embodiment. When the rib 136 is inserted into the rotating member 108, the rib 136 is biased against and digs into the inner surface of the rotating member 108 and the cap 104 is thereby locked onto the rotating member 108. In various embodiments, the cap 104 detachably engages the rotating member 108 such that the cap 104 is secured to the rotating member 108 but can be removed if desired by the user. In various embodiments, this can be accomplished by sizing the outer diameter of the rib 136 so that the rib 136 is biased against and digs into the inner surface of the rotating member 108 but is not too tight to pull the cap 104 away from the rotating member 108 with sufficient force by hand. In various embodiments, once the cap 104 is attached to the rotating member 108, the cap 104 prevents or resists removal of the holding member 102 from the rotating member 108 over the first end 110 of the rotating member 108.

Figure 7:
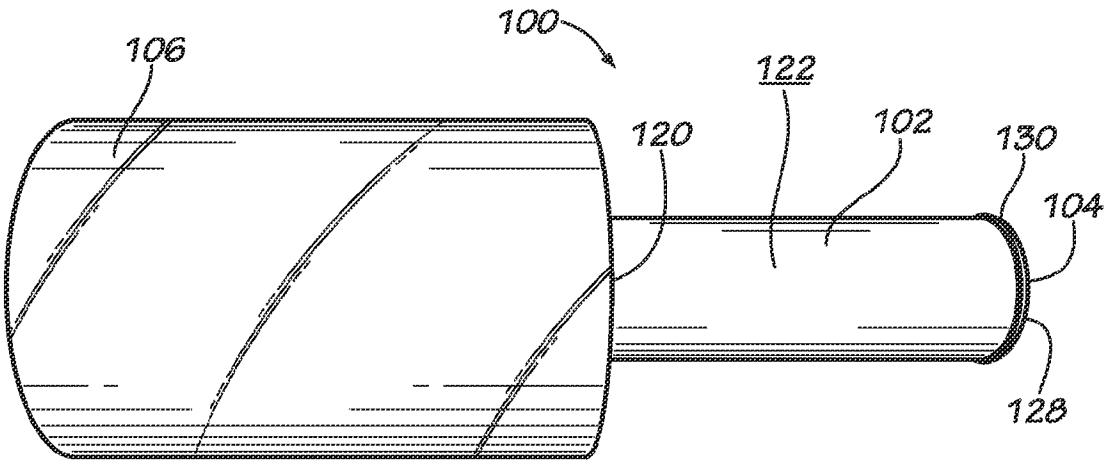
FIG. 7 is a side view of the assembled wrap dispenser of FIG. 1.

FIG. 7 shows a side view of the assembled dispenser 100. As previously described, wrap 106 is typically rolled around the rotating member 108 to create the roll of wrap 106. As shown in FIG. 7, the holding member 102 is positioned over the rotating member 108 such that the second end 120 is adjacent to the roll of wrap 106. In these embodiments, the inner surface 146 of the holding member 102 is adjacent to the outer surface 144 of the engaging portion 114 of the rotating member 108. The cap 104 is positioned such that the attachment mechanism of the cap 104 attaches to the rotating member 108 and detachably engages the cap 104 to the dispenser 100. As shown in FIG. 7, in these embodiments, $D_4$ is about equal to $D_3$ such that the end 130 is about flush with the outer holding surface 122.

As shown in FIG. 7, once the cap 104 is attached to the rotating member 108, the cap 104 abuts the holding member 102 and, in combination with the wrap 106, captures and holds the holding member 102 on the rotating member 108 between the cap 104 and the wrap 106. In the current embodiment, the cap 104 abuts the first end 110 of the holding member 102 such that the cap 104 can contact the holding member 102 and prevent the holding member 102 from sliding off the rotating member 108 over the first end 110 of the rotating member 108. In these embodiments, the cap 104 is not attached to the holding member 102 and the holding member 102 can slide on the rotating member 108 away from cap 104 and create separation between the cap 104 and the holding member 102, though in various embodiments the wrap 106 and cap 104 may be spaced apart at a distance such that the holding member 102 cannot slide axially.

Figure 8:
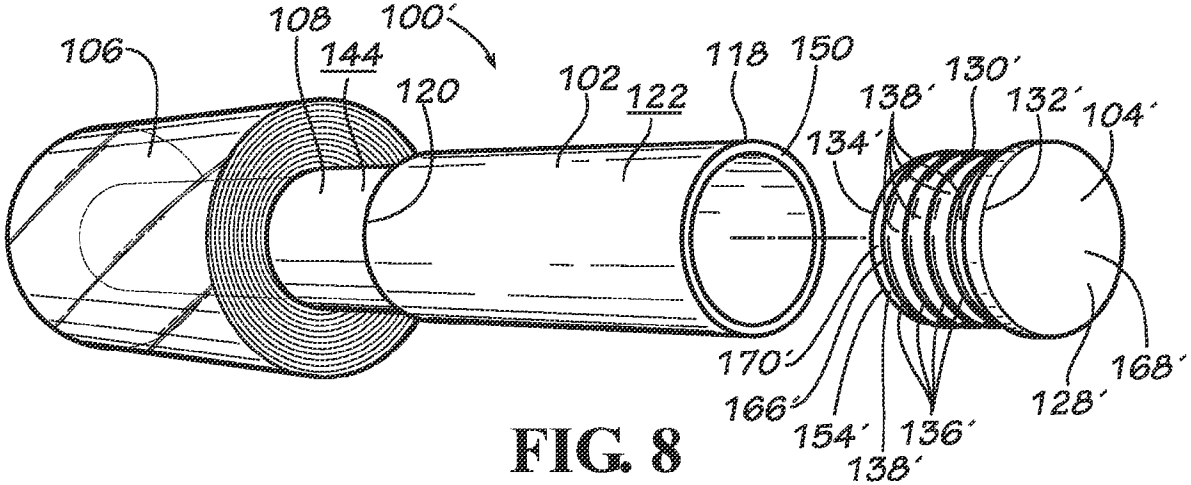
FIG. 8 is a partially-exploded perspective view of a wrap dispenser including the rotating member and holding member of FIG. 1 with a cap according to another embodiment of the present disclosure.

FIG. 8 shows a partially exploded perspective view of a dispenser 100' in accordance with another embodiment of the current disclosure. As shown in FIG. 8, in the current embodiment, the dispenser 100' includes cap 104' instead of cap 104. Cap 104' includes a flange portion 124' and an insertion portion 126'. The insertion portion 126' has a circumferential wall 170' having an outer surface 166'. In various embodiments, the circumferential wall 170' defines a cavity extending inward from a second end 134' into the insertion portion 126'. As shown in FIG. 8, the outer surface 166' defines a plurality of ribs 136' and grooves 138' for detachably engaging the rotating member 108. In various embodiments, the plurality of ribs 136' are configured to be biased against and dig into the inner surface of the rotating member 108 when the cap 104' is attached to the rotating member 108. As shown in FIG. 8, in various embodiments, the flange portion 124' of the cap 104' includes an inner end 130' and a first end 128' having an outer surface 168'. In the present embodiment, the cap 104' further includes a side surface 132' squared to the first end 128'. The angle of the side surface 132' relative to the first end 128' should not be considered limiting on the current disclosure.

Figure 9:
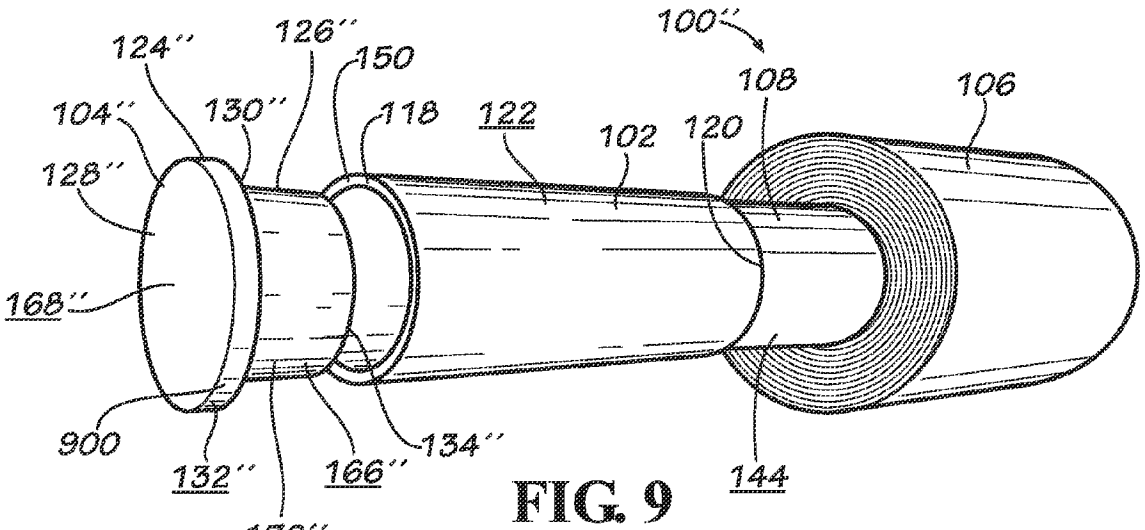
FIG. 9 is a partially-exploded perspective view of a wrap dispenser including the rotating member and holding member of FIG. 1 with a cap according to another embodiment of the present disclosure.

FIG. 9 shows a partially exploded perspective view of a dispenser 100" in accordance with another embodiment of the current disclosure. As shown in FIG. 9, in the current embodiment, the dispenser 100" includes the holding member 102, rotating member 108, and roll of wrap 106. The dispenser 100" also includes cap 104" instead of cap 104' or cap 104. Cap 104" includes a flange portion 124" and an insertion portion 126". The insertion portion 126" has an inner circumferential wall 170" having an outer surface 166". In various embodiments, the inner circumferential wall 170" is cylindrical and defines a cavity 154" (shown in FIG. 12) extending inward from a second end 134" into the insertion portion 126". In various other embodiments, the insertion portion 126" is substantially solid and does not define a cavity. As shown in FIG. 9, in various embodiments, the flange portion 124" of the cap 104" includes an inner end 130" and a first end 128". As shown in FIG. 9, the first end 128" defines an outer surface 168". In the present embodiment, the cap 104" further includes an outer circumferential wall 900 having a side surface 132" extending at a right angle from the first end 128", though the angle of the side surface 132" relative to the first end 128" should not be considered limiting on the current disclosure.

Figure 10:
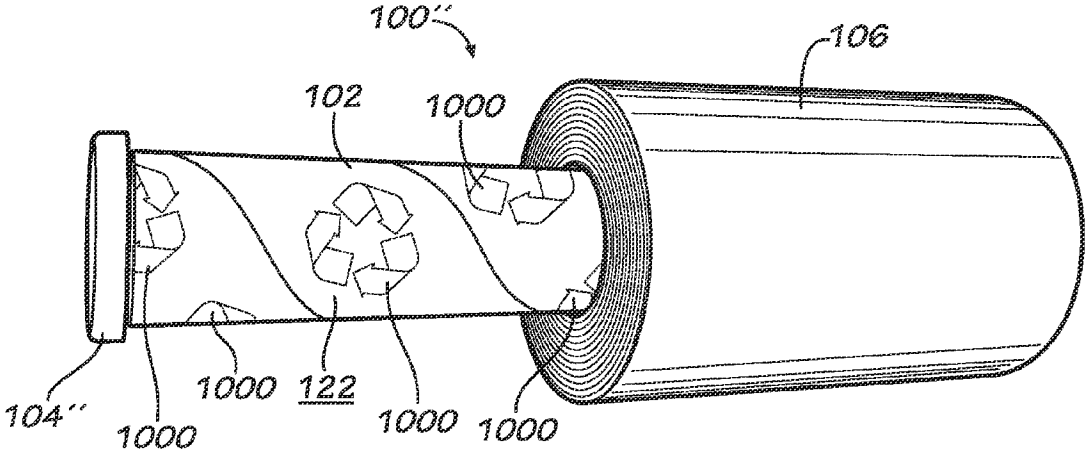
FIG. 10 is a side view of the assembled wrap dispenser of FIG. 9.

FIG. 10 shows the assembled wrap dispenser 100" with cap 104". As shown in FIG. 10, in various embodiments, the outer holding surface 122 of the holding member 102 may include printed or imprinted designs 1000. These designs 1000 may serve aesthetic purposes such as creative designs to ornament the holding member 102. In various other embodiments, the outer holding surface 122 with printed or imprinted designs 1000 may serve utilitarian purposes such as to provide instructions for use of the wrap dispensers 100,100',100" or advertising space for companies or other entities to print or imprint their images, logos, slogans, or any other design associated with that entity. In various embodiments, the outer holding surface 122 may include a single image, word, or design or a plurality of images, words, or designs. In various embodiments where the outer holding surface 122 includes designs 1000, the outer holding surface 122 may be pre-printed with the designs 1000 on the outer holding surface 122. In various embodiments where the holding member 100 is formed through spiral wrapping of a flat sheet including multiple layers of paper, the final exterior layer of paper, which forms the outer holding surface 122 when wrapped, may include a pre-printed layer having designs 1000. The pre-printed layer is glued to the underlying layers of paper before the sheet is spiral wrapped into a tubular shape and cut into the desired lengths. In various other embodiments, the designs 1000 may be included on a pressure-sensitive label such as a pre-adhesive with a backing that may be peeled off prior to the label being attached to the outer holding surface 122 of the holding member 102. In various other embodiments, the designs 1000 may be included on a label with a water-activated adhesive. This may allow for a larger label design that matches up to the size and dimensions of the holding member 102 and outer holding surface 122.

FIG. 11 shows a side view of cap 104". As previously described, the cap 104" includes the flange portion 124" and the insertion portion 126". The flange portion 124" includes outer circumferential wall 900 having the side surface 132", the first end 128", and the inner end 130". As shown in FIG. 11, the cap 104" defines an outer surface 168" at the first end 128". In various embodiments, the side surface 132" intersects the first end 128" at a right angle; however, in various other embodiments, the side surface 132" may be angled relative to the first end 128". As shown in FIG. 11, in various embodiments, the cap 104" may define a tapered edge 1100 between the side surface 132" and first end 128" and a tapered edge 1102 between the side surface 132" and the inner end 130". In various other embodiments, the edges 1100,1102 may be rounded, square, or have any other desired edge shape.

As shown in FIG. 11, the insertion portion 126" has the inner circumferential wall 170" having the outer surface 166". In various embodiments, as shown in FIG. 11, the inner circumferential wall 170" also has a tapered surface 1104 between the second end 134" and the outer surface 166".

FIG. 12 shows a cross-sectional view of cap 104" taken along line 12-12 in FIG. 11. As shown in FIG. 12, in various embodiments, the inner circumferential wall 170" defines a cavity 154" extending inward from the second end 134" into the insertion portion 126". In various embodiments, cavity 154" extends partially into flange portion 124". In various embodiments, the cavity 154" includes a bottom surface 156" and an annular or cylindrical side surface 158" extending from the bottom surface 156" to the second end 134". As shown in FIG. 12, in various embodiments, the outer circumferential wall 900 includes an inner surface 1200. In various embodiments, the cap 104" includes an annular end surface 164" extending between the inner surface 1200 and the outer surface 166". In combination, the annular end surface 164", the inner surface 1200, and the outer surface 166" define an annular pocket 162'. In various embodiments, the rotating member 108 and holding member 102 may be inserted into the annular pocket 162' when the cap 104" is attached to the wrap dispenser 100". When the cap 104" is attached to the dispenser 100", the annular end surface 164" is positioned adjacent to the cap side surface 150 of the holding member 102 and first end 110 of the rotating member 108 such that the cap side surface 150 and first end 110 abut the annular end surface 164". In these embodiments, the annular end surface 164" abuts the cap side surface 150 even though the holding member 102 is not attached to the cap 104". In various embodiments, the annular end surface 164" can contact the cap side surface 150 of the holding member 102 such that the holding member 102 is slidable against the cap 104".

In various embodiments, the cap 104" has a generally circular shape with an outermost diameter $D_5$ of the pocket 162' defined by the surface 1200 of the pocket 162'. In various embodiments, $D_5$ is greater than $D_3$. The cap 104" also has an inner diameter of the pocket 162" $D_6$ defined by the surface 166" of the pocket 162' at the inner circumferential wall 170". In various embodiments, a width of the annular pocket 162' is defined as the difference between $D_5$ and $D_6$. In various embodiments, the width of the annular pocket is at least equal to a combination of $D_1$ and $D_3$. The shape of the cap 104" should not be considered limiting on the current disclosure as in various other embodiments, the cap 104" may be square, oval, angled, or have any other desired shape.

FIG. 13 shows the cap 104" partially inserted into the holding member 102 and rotating member 108. As shown in FIG. 13, when the insertion portion 126" is inserted into the rotating member 108, the outer surface 166" of the inner circumferential wall 170" is positioned adjacent to and in contact with the inner surface 1300 of the rotating member 108 such that the outer surface 166" engages the inner surface 1300 upon insertion of the cap 104". In various embodiments, $D_6$ is approximately equal to or greater than the diameter of the inner surface 1300 such that the cap" stays attached to the rotating member 108. In various embodiments, when the cap 104" is attached to the rotating member 108, at least a portion of the outer circumferential wall 900 overlaps the outer holding surface 122. In various embodiments, a gap 1302 is defined between the inner surface 1200 of the outer circumferential wall 900 and the outer holding surface 122 such that the cap 104" is rotatable with the rotating member 108 relative to the holding member 102.

In various embodiments, the cap 104" detachably engages the rotating member 108 such that the cap 104" is secured to the rotating member 108 but can be removed if desired by the user. In various embodiments, this can be accomplished by sizing the inner circumferential wall 170" such that the inner circumferential wall 170" is biased against and digs into the inner surface 1300 of the rotating member 108 but is not too tight to pull the cap 104" away from the rotating member 108 with sufficient force by hand. In various embodiments, once the cap 104" is attached to the rotating member 108, the cap 104" prevents or resists removal of the holding member 102 from the rotating member 108 over the first end 110 of the rotating member 108. In various embodiments, tapered surface 1104 serves as a guide and a ramp to ease sliding of the insertion portion 126" into the rotating member 108. In various embodiments where $D_6$ is greater than the diameter of the inner surface 1300, tapered surface 1104 makes it possible to slide the insertion portion 126" of the cap 104" into the rotating member 108.

In various embodiments, once the cap 104" is attached to the rotating member 108, the cap 104" abuts the holding member 102 and, in combination with the wrap 106, captures and holds the holding member 102 on the rotating member 108 between the cap 104" and the wrap 106. In the current embodiment, the cap 104" abuts the first end 110 of the holding member 102 such that the cap 104" can contact the holding member 102 and prevent the holding member 102 from sliding off the rotating member 108 over the first end 110 of the rotating member 108. The cap 104" also includes the outer circumferential wall 900 at least partially overlapping the holding member 102 such that the holding member is captured between the outer circumferential wall 900 and the inner circumferential wall 170". In these embodiments, the cap 104" is not attached to the holding member 102 and the holding member 102 can slide on the rotating member 108 away from cap 104" and create separation between the cap 104" and the holding member 102, though in various embodiments the wrap 106 and cap 104" may be spaced apart at a distance such that the holding member 102 cannot slide axially.

Referring back to FIG. 2, a method of assembling the dispenser 100 is described in further detail. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. A rotating member 108 with a roll-holding portion 116, an engaging portion 114, an axis of rotation 140, and a roll of wrap 106 positioned on the roll-holding portion 116 is initially provided. The wrap 106 is typically wrapped around the rotating member 108 during the manufacturing process to form the roll of wrap 106 positioned on the rotating member 108.

A holding member 102 is positioned on the rotating member 108 such that the holding member 102 encloses the engaging portion 114 of the rotating member 108. In particular, in the current embodiment, when the holding member 102 encloses the rotating member 108, the inner surface 146 of the holding member 102 is positioned adjacent to the outer surface 144 of the rotating member 108. Furthermore, when the holding member 102 is fully positioned onto the rotating member 108, the second end 120 is positioned adjacent to roll of wrap 106. When the holding member 102 is positioned on the rotating member 108, the longitudinal axis 148 of the holding member 102 becomes substantially aligned with the axis of rotation 140 of the rotating member 108.

The cap 104 is attached proximate to the first end 110 of the rotating member 108. Attaching the cap 104 prevents removal of the holding member 102 from the rotating member 108 over the first end 110 of the rotating member 108. In particular, attaching the cap 104 captures and holds the holding member 102 on the engaging portion 114 of the rotating member 108 between the roll of wrap 106 positioned on a roll-holding portion 116 of the rotating member 108 and the first end 110 of the rotating member 108. This may prevent the holding member 102 from coming off the dispenser 100 during use. In various embodiments, the cap 104 is detachably attached to the first end 110 of the rotating member 108 and abuts the holding member 102. In these embodiments, the cap 104 includes an attachment mechanism for detachably engaging the rotating member 108. In various embodiments, the attachment mechanism includes a rib 136 having an outer diameter greater than an inner diameter of an inner surface of the rotating member 108.

When the cap 104 is attached to the dispenser 100, the annular end surface 164 of the cap 104 is adjacent to the first end 118 and cap side surface 150 of the holding member 102. In various embodiments, when the cap 104 is attached to the dispenser 100, a separation gap (not shown) may be formed between the annular end surface 164 and the cap side surface 150. This gap allows for free rotation of the rotating member 108 while a user holds the holding member 102 without generating any friction between the cap 104, which will rotate with the rotating member 108, and the holding member 102.

Figure 14:
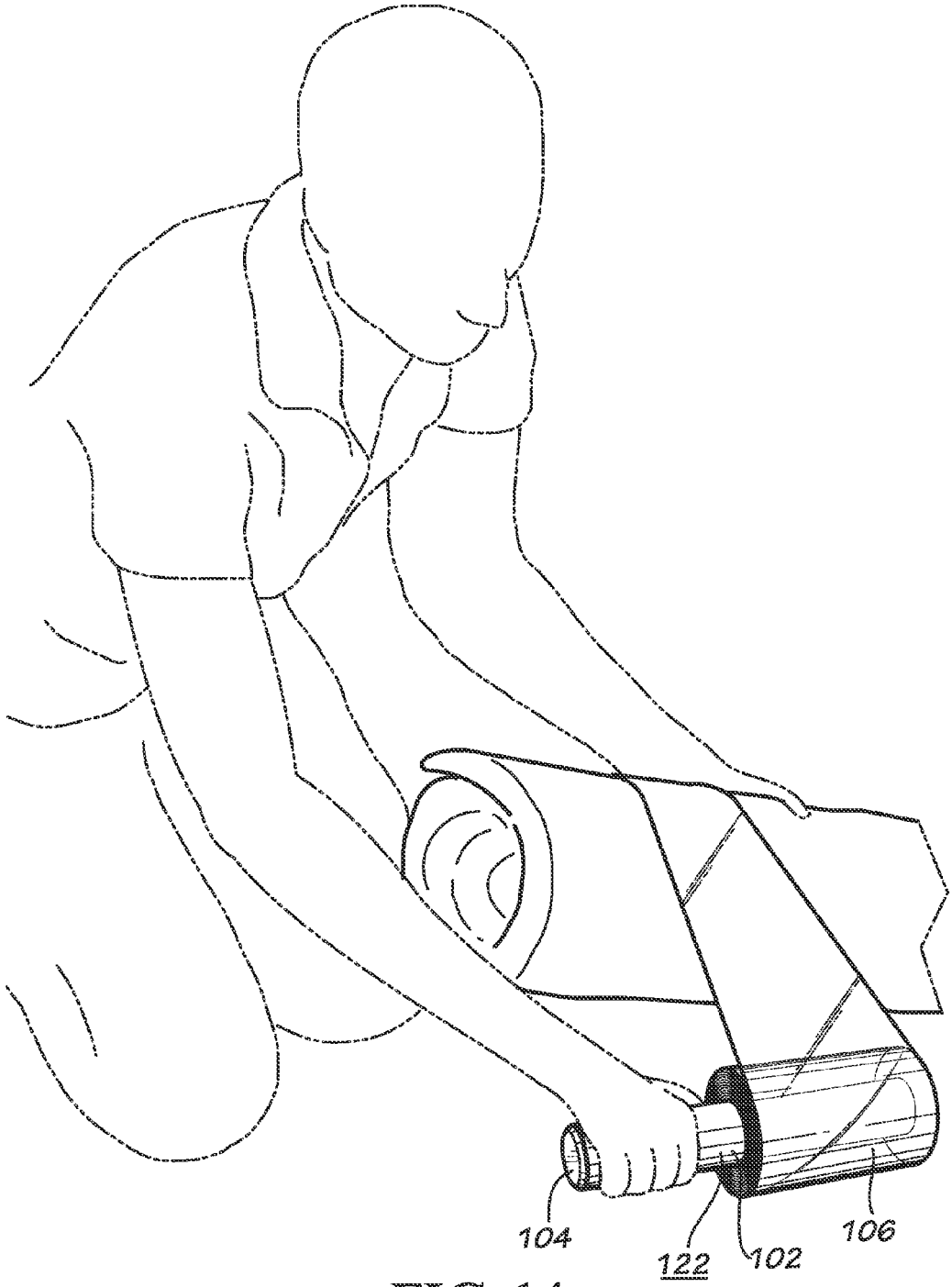
FIG. 14 is perspective view of the wrap dispenser of FIG. 1 being held by a user.

Focusing now on FIG. 14, a method of dispensing wrap 106 using a dispenser 100 will be described in further detail. A user first obtains a wrap dispenser 100 which includes the rotating member 108 with wrap 106 wrapped around the rotating member 108, the holding member 102 on the engaging portion 114 of the rotating member 108, and the cap 104 attached to the rotating member 108 such that the cap 104 and wrap 106 capture the holding member 102 on the engaging portion 114 of the rotating member 108. The user holds and grips the outer holding surface 122 of the holding member 102 and begins dispensing the wrap 106. Although the user is holding the holding member 102, the rotating member 108 freely rotates around its axis of rotation 140 to dispense the film because the inner surface 146 of the holding member 102 is not compressed against the outer surface 144 of the engaging portion 114 of the rotating member 108 and the inner surface 146 and outer surface 144 are sufficiently smooth in the current embodiment that the friction between the inner surface 146 and outer surface 144 is not sufficient to significantly resist rotation of the rotating member 108. As the film is being dispensed, the user may increase tension in the film by clenching his or her hand and applying pressure to the holding member 102. In various embodiments, the holding member 102 directly engages the rotating member 108 when compressed to stop rotation of the rotating member 108. In particular, frictional engagement occurs when the inner surface 146 of the holding member 102 directly engage the outer surface 144 of the rotating member 108 after the inner surface 146 collapses during compression. This frictional engagement increases friction between the rotating member 108 and the holding member 102 due to the increased surface contact between the inner surface 146 and the outer surface 144 and causes the rotating member 108 to slow down or stop rotating altogether. This results in tensioning or even stretching of the wrap to occur when the user holds the dispenser 100 in place or continues to move the dispenser 100 with the roll of wrap 106, as previously described. Thus the dispenser 100 holds the wrap taut around the object or objects being wrapped, preventing the unrolled wrap from becoming loose around the object or objects or during the dispensing. In various other embodiments, the user may also slide the holding member 102 along the rotating member while clenching the holding member 102 such that the cap side surface 150 of the holding member 102 frictionally engages the annular end surface 164 of the cap 104. In these embodiments, the frictional engagement between the compressed holding member 102 and the rotating member 108 and between the holding member 102 and the cap 104 causes the rotating member 108 to slow down or stop rotating altogether. This results in tensioning or even stretching of the wrap to occur when the user holds the dispenser 100 in place or continues to move the dispenser 100 with the roll of wrap 106, as previously described.

This assembly configuration represents one of many possible assembly configurations. One skilled in the art will understand that obvious variations of this assembly configuration are included within this disclosure, including variations of steps, combinations of steps, and dissections of steps, among others. Where materials are chosen for the elements of this assembly, particularly corrugated or uncorrugated paperboard, rubber, metal, and plastic, similar material choices may also be used and would be obvious to one in the art. In particular, the rotating member 108 and/or holding member 102 is constructed from the group including, but not limited to, corrugated or uncorrugated paperboard, cast iron, steel, aluminum, titanium, copper, brass, various plastics, resins, composites, or any material of sufficient strength to withstand the loads placed on them when dispensing film or other wrap materials from a roll but resilient enough to allow compression of the holding member 102 to frictionally engage the rotating member 108, or any combination of the foregoing materials. In particular, in various embodiments, the holding member 102 and the rotating member 108 are made from a corrugated paperboard. In various other embodiments, the holding member 102 may be made from polyethylene foam and the rotating member is made from plastic or corrugated paperboard. The cap 104 is constructed from the group including, but not limited to, flexible and resilient material that may be selectively compressed or deformed to allow detachable engagement with the rotating member 108 such as a plastic or rubber-like material. In various other embodiments, only a portion of the cap 104 is constructed from plastic or rubber-like material. Another portion may be constructed from various other metals, plastics, resins, composites, or other material that need not be flexible and resilient. Furthermore, the configuration of either member need not be annular but could be another configuration depending on the application. Finally, additional members may be added to the wrap dispenser 100 and various components may be split into other components. For one example among others, an elastomeric component may be applied to the outer holding surface 122 of the holding member 102 to aid in grip. In such a case, the elastomeric component would be considered a portion of the holding member 102. This elastomeric component could be added to a plastic holding member 102 using molding technology or methods known in the art.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A dispenser comprising:

a rotating member including a first end and a second end, the rotating member having an inner surface and defining an axis of rotation that extends from the first end to the second end;

a holding member having an inner surface and an outer holding surface, the inner surface of the holding member enclosing an engaging portion of the rotating member; and a cap attached to the first end of the rotating member and holding the holding member, an insertion portion of the cap extending into the rotating member, the insertion portion frictionally engaging the inner surface of the rotating member to rotationally fix the cap to the rotating member, the cap including an outer circumferential wall and an inner circumferential wall, the cap enclosing a portion of the holding member between the outer circumferential wall and the inner circumferential wall, a portion of the holding member positioned radially inward from the outer circumferential wall relative to the axis of rotation.

2. The dispenser of claim 1, wherein the cap includes an attachment mechanism for detachably engaging the rotating member.

3. The dispenser of claim 1, further comprising wrap rolled around the rotating member, the cap and the wrap capturing and holding the holding member on the rotating member between the cap and the wrap.

4. The dispenser of claim 1, wherein:

the cap further defines an end surface;

the holding member defines a cap end surface at a first end; and the end surface of the cap is slidable against the cap end surface of the holding member as the holding member rotates relative to the cap.

5. The dispenser of claim 1, wherein the outer holding surface of the holding member includes printed or imprinted designs.

6. The dispenser of claim 5, wherein the printed or imprinted designs are on a pre-printed layer assembled into a flat sheet, the pre-printed layer assembled into the flat sheet prior to the flat sheet being wrapped and cut to form the holding member.

7. The dispenser of claim 5, wherein the printed or imprinted design are on an adhesive-backed label with printed information.

8. A method of assembling a wrap dispenser comprising:

enclosing an engaging portion of a rotating member with a holding member; and attaching a cap proximate to a first end of the rotating member by frictionally engaging an insertion portion of the cap to an inner surface of the rotating member and enclosing a portion of the holding member between an outer circumferential wall and an inner circumferential wall of the cap, a portion of the holding member positioned radially inward from the outer circumferential wall relative to an axis of rotation of the rotating member, the cap rotationally fixed to the rotating member, the cap preventing removal of the holding member from the rotating member over the first end of the rotating member.

9. The method of claim 8, wherein attaching the cap includes capturing and holding the holding member between a roll of wrap positioned on a roll-holding portion of the rotating member and the cap.

10. The method of claim 9, wherein the cap is detachably attached to the first end of the rotating member and abuts the holding member.

11. The method of claim 8, wherein the cap includes a rib for detachably engaging the rotating member.

12. The method of claim 8, wherein prior to enclosing the engaging portion of the rotating member with the holding member, the method further comprises:

wrapping a sheet to form a tubular shape; and cutting the wrapped sheet to form the holding member.

13. The method of claim 12, further comprising assembling a pre-printed layer into the sheet prior to wrapping and cutting the sheet to form the holding member, the pre-printed layer having at least one printed or imprinted design.

14. The method of claim 12, further comprising applying an adhesive label to the formed, cut, holding member, the adhesive label having at least one printed or imprinted design.

15. A method of dispensing wrap from a roll using a dispenser, the method comprising:

gripping onto an outer holding surface of a holding member of the dispenser, the holding member enclosing an engaging portion of a rotating member of the dispenser, the dispenser further including:

wrap wrapped around a roll-holding portion of the rotating member, and a cap attached to the first end of the rotating member and holding the holding member, an insertion portion of the cap extending into the rotating member, the insertion portion frictionally engaging an inner surface of the rotating member to rotationally fix the cap to the rotating member, the cap including an outer circumferential wall and an inner circumferential wall, the cap enclosing a portion of the holding member between the outer circumferential wall and the inner circumferential wall, a portion of the holding member positioned radially inward from the outer circumferential wall relative to an axis of rotation of the rotating member; and dispensing the wrap by rotating the rotating member relative to the holding member.

16. The method of claim 15, further comprising applying pressure onto the holding member to increase the tension in the wrap being dispensed.

17. The method of claim 16, wherein applying pressure onto the holding member includes compressing holding member to engage the rotating member, and wherein compressing the holding member includes increasing the resistance to rotation of the rotating member and tension in the wrap by increasing the friction between the rotating member and the holding member.

18. A dispenser comprising:

a rotating member having a first end defining a continuous unbroken circle and a second end defining a continuous unbroken circle, the rotating member defining an axis of rotation that extends from the first end to the second end;

a holding member having a first end defining a continuous unbroken circle and a second end defining a continuous unbroken circle, the holding member having an inner surface and an outer holding surface, the inner surface enclosing an engaging portion of the rotating member; and a cap attached to the first end of the rotating member and holding the holding member, an insertion portion of the cap extending into the rotating member, the insertion portion frictionally engaging an inner surface of the rotating member to rotationally fix the cap to the rotating member, a portion of the holding member positioned radially inward from a portion of the cap relative to the axis of rotation.

19. The dispenser of claim 18, wherein the rotating member is a continuous cylinder and wherein the holding member is a continuous cylinder.

20. The dispenser of claim 18, wherein the cap includes an outer circumferential wall and an inner circumferential wall, the cap enclosing a portion of the holding member between the outer circumferential wall and the inner circumferential wall.

21. The dispenser of claim 1, wherein the rotating member is cylindrical in shape, and the second end of the rotating member opposite the cap is open.

22. The dispenser of claim 18, wherein a first outer diameter of the first end of the holding member is equal to a second outer diameter of the second end of the holding member.

23. The dispenser of claim 18, wherein the holding member has a wall thickness defined between the inner surface and the outer surface of the holding member, and the wall thickness is constant for the entire holding member.

24. The dispenser of claim 19, wherein the second end of the rotating member is open.

* * * * *